US010759629B2

(12) United States Patent
Pilar

(10) Patent No.: US 10,759,629 B2
(45) Date of Patent: Sep. 1, 2020

(54) METHOD FOR CONTROLLING AN ATTENDING DEVICE OF A WORKSTATION OF A YARN MANUFACTURING TEXTILE MACHINE, AND A TEXTILE MACHINE

(71) Applicant: Maschinenfabrik Rieter AG, Winterthur (CH)

(72) Inventor: Evzen Pilar, Litomysl (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 24 days.

(21) Appl. No.: 16/169,356

(22) Filed: Oct. 24, 2018

(65) Prior Publication Data

US 2019/0119062 A1 Apr. 25, 2019

(30) Foreign Application Priority Data

Oct. 24, 2017 (CZ) ..... 2017-674

(51) Int. Cl.

| | |
|---|---|
| ***B65H 54/26*** | (2006.01) |
| ***D01H 1/20*** | (2006.01) |
| ***D01H 4/42*** | (2006.01) |
| ***D01H 4/48*** | (2006.01) |
| ***D01H 15/013*** | (2006.01) |
| ***D01H 13/00*** | (2006.01) |
| ***B65H 54/36*** | (2006.01) |

(52) U.S. Cl.

CPC ..... *B65H 54/26* (2013.01); *D01H 1/20* (2013.01); *D01H 4/42* (2013.01); *D01H 4/48* (2013.01); *D01H 13/005* (2013.01); *D01H 15/013* (2013.01); *B65H 54/36* (2013.01); *B65H 2701/31* (2013.01)

(58) Field of Classification Search

CPC .... B65H 2701/31; B65H 54/26; B65H 54/36; D01H 13/005; D01H 15/013; D01H 1/20; D01H 4/42; D01H 4/48

See application file for complete search history.

(56) References Cited

U.S. PATENT DOCUMENTS

| | | | | |
|---|---|---|---|---|
| 6,226,971 | B1 | 5/2001 | Stephan | |
| 7,010,383 | B2 | 3/2006 | Zipperer | |
| 2003/0056486 | A1 | 3/2003 | Bahlmann et al. | |
| 2005/0182509 | A1* | 8/2005 | Brandl | D01H 13/005 700/139 |
| 2017/0009386 | A1 | 1/2017 | Stephan | |

FOREIGN PATENT DOCUMENTS

| | | | |
|---|---|---|---|
| CZ | 20022586 | A3 | 3/2003 |
| CZ | 20041057 | A | 6/2005 |
| DE | 199 17 971 | B4 | 11/1999 |
| EP | 0 394 671 | A | 10/1990 |
| EP | 3 115 487 | A1 | 1/2017 |

OTHER PUBLICATIONS

Czech Republic Search Report, dated Jul. 17, 2018.

* cited by examiner

*Primary Examiner* — Yuhui R Pan

(74) *Attorney, Agent, or Firm* — Dority & Manning, P.A.

(57) ABSTRACT

A method is provided for controlling movement and operation of an attending device of a yarn manufacturing textile machine, wherein the attending device moves along a row of workstations arranged next to each other to perform operations at the workstations. The method controls the movement of the attending device along the work stations and operations of the attending device based on success statistics of the operations at the workstations to achieve an overall increased efficiency of the textile machine. An operational stay of the attending device at a particular one of the work stations is terminated without waiting for a result of the operation being performed by the attending device at the particular workstation.

9 Claims, No Drawings

METHOD FOR CONTROLLING AN ATTENDING DEVICE OF A WORKSTATION OF A YARN MANUFACTURING TEXTILE MACHINE, AND A TEXTILE MACHINE

TECHNICAL FIELD

The invention relates to a method for controlling an attending device of a workstation of a yarn manufacturing textile machine which controls the movement of the attending device along a row of workstations arranged next to each other and controls the operation of the attending device at the respective workstation, whereby the movement of the attending device along the row of workstations and servicing the workstations are controlled to achieve the highest possible machine efficiency based on the statistical success of operations at the workstations.

The invention also relates to a device for performing controlling activity and evaluating the operation of an attending device of a workstation of a yarn manufacturing textile machine. The movement of the attending device along a row of workstations arranged next to each other is controlled by the control unit of the machine equipped with a module for evaluating the control activities and cooperation of the attending devices and the workstations using a mathematical model that takes into account selected production-related parameters and quality, and also their possible interaction and combinations, namely with a view to achieving the greatest possible production efficiency of the entire textile yarn manufacturing machine during its production activity, determining the operation of the attending devices and their possible interaction with partial or complete handling means of the workstation.

BACKGROUND

Yarn manufacturing textile machines comprise at least one row of identical workstations arranged next to each other on which yarn is wound on bobbins. For a variety of reasons, such as increasing the speed of spinning and the speed of winding yarn, reducing human labour, improving the quality and uniformity of the attending operations at the workstations, etc., yarn manufacturing textile machines are equipped with at least one attending device that is movable along the row of workstations and is provided with working means for performing required operations, or at least part of the operations, at the individual workstations. There are other types of yarn making textile machines that include workstations, each of which is provided with its own handling means performing partially or completely the attending operations or participate in the attending operations in cooperation with an attending device.

During the activities of the attending device on a yarn manufacturing textile machine, for example, during the resumption of the spinning process at the workstations after previous termination of production at part of the workstations or at all the workstations, or after the doffing of a wound bobbin and exchanging it for an empty tube, or after a yarn break at the workstation, etc., it is necessary not only to control the movement of the attending device along the row of workstations, but also to control the individual attending activities performed at the workstations.

Methods for controlling the movement and operation of an attending device for attending the workstations of a yarn manufacturing textile machine are known which use various information about the course of production at the individual workstations and about the previous activities of the attending devices on the machine and at the individual workstations. However, these methods of control work mostly with a pre-set fixed algorithm, which can be altered externally to the machine by the machine operator but which cannot be changed during the operation of the attending device. In the event of a failure of an attending operation carried out by the attending device, the attending device makes a new attempt to perform successfully the attending operation, whereby the maximum number of attempts to carry out the attending operation is pre-set in the control system. If the last attempt to perform an attending operation from a set number of attempts does not lead to a successful operation at the given workstation, the workstation is evaluated by the control unit as a workstation with a fault and the machine operator is informed about this.

According to another known method of control, the attending device moves according to the information from the control unit along the row of workstations from one workstation being operated to another in such a manner that it moves to the closest workstation requesting an attending operation and carries out the attending operation either independently or in cooperation with the handling means of the workstation. This procedure, which is pre-programmed, is repeated. The attending device usually moves to the workstations in which the production process is to be resumed by operating the workstations one by one in the sequence in which they have been stopped but with regard to the operation of any other attending device present on the same machine.

EP 394 671 discloses a method for controlling an attending device moves along a row of workstations from one end of a yarn manufacturing textile machine to the other end and back again and then repeats this procedure. In doing so, it stops in succession (one at a time) at the workstations at which attending activities have to be performed if it is possible. At the workstations where the need for an attending operation has occurred only after the mobile attending device has passed past these workstations, the attending operation is performed only after the attending device has passed these workstations again when moving in the opposite direction.

DE 19 917 971 describes a method for controlling an attending device that is provided with a control unit communicating with the control unit of the machine, wherein the attending device moves along a row of workstations of a yarn manufacturing textile machine and stops in succession at the workstations (at one at a time) where it performs an attending operation until it is successfully completed by one or even more (e.g. 2) pre-determined attempts. Only when the pre-determined maximum number of unsuccessful attempts has been exceeded, the attending operation is interrupted and the workstation which has not been set into operation is marked and stored in memory. The attending device then moves and operates the next closest workstation requesting an attending operation. A new maximum number (e.g. 3) of attempts to perform the attending operation can be set before the next passage of the attending device past the unsuccessfully spun-in workstation, which the attending device can carry out during a new passage. Only when this new limit of the number of attempts is exceeded, the workstation of the textile machine is assessed by the control unit as incapable of operation, whereby the unsuccessful attempts of attending activities are classified and counted according to the type of failure.

EP 3 115 487 discloses a method for controlling an attending device of a yarn manufacturing textile machine provided with a control unit or connection to a control unit, in which the attending device moves along a row of workstations equipped with yarn sensors monitoring the parameters and presence of the produced yarn. The workstations can have their own complete or partial handling means for resuming the manufacturing process which cooperate with the attending device in performing the attending operations. Each workstation is continuously evaluated according to one or more production-related parameters and on the basis of this evaluation, the sequence of the workstations to be serviced or to be spun in for the resumption of the production is determined with the aim of achieving the maximum production efficiency of the entire machine. The parameters evaluated include, for example, the reliability of the workstation operation, the time needed to renew production and the number of attempts for successful resumption of the production, the production efficiency of the workstation, the amount or the length of the yarn produced per time unit, the operating time of selected components, etc. All these parameters are used as input parameters for the mathematical model of the machine operation which is created for this purpose, whereby the procedure of the control operations to resume production is approved prior to commencing attending activities at the workstation.

If these parameters are considered upon the selection of the next workstation where the production will be resumed, the total time that is required for the resumption of the manufacturing process of the workstation of the yarn manufacturing textile machine per hour of operation can be minimized, and/or the overall production efficiency of the yarn manufacturing textile machine can be increased.

SUMMARY OF THE INVENTION

The aim of the invention is to optimize the operation of the attending device in order to increase the productivity of the entire machine. Additional objects and advantages of the invention will be set forth in part in the following description, or may be obvious from the description, or may be learned through practice of the invention.

The goal of the invention is achieved by controlling an attending device of a yarn manufacturing textile machine, whose principle consists in that the attending device terminates its stay at one workstation and moves to another workstation without waiting for the result of the attending operation at the respective one workstation.

The goal of the invention is further achieved by a yarn manufacturing textile machine whose principle consists in that the attending device terminates its stay at the workstation without waiting for the result of the attending operation at this one workstation. The invention uses the fact that the workstations are continually evaluated according to one or more production-related parameters and on the basis of this evaluation, the sequence of the workstations for the resumption of the production process is determined with the aim of maximum production efficiency of the entire yarn manufacturing machine. From the individual workstations equipped with sensors monitoring the parameters and presence of the produced yarn, information is passed to the control unit of the machine and, together with the information about the course and success rate of the attending operations performed at the workstations by the attending devices or the attending device of the workstation or by the cooperation thereof, the control unit, after the evaluation of the current state of the individual workstations and according to predetermined parameters, makes a decision using a mathematical model about the sequence in which the workstations will be operated or makes a decision whether the attending operation at the workstation will be completed or whether it will be interrupted and the attending operation will be performed at a different workstation. This evaluation is carried out continuously, especially during or even after complete or partial attending operation. The control unit of the machine gives and updates commands during the attending operation at the workstation, or after it, and determines whether the attending device performs, e.g., one attempt to resume production activity out of, e.g., three predetermined attempts, during the attending operation at the specific workstation, the number of the attempts having been specified according to the previous behaviour of the workstation during the attending operation, or it starts to perform attending operations at another workstation at which faster resumption of the working activity will be more preferable in respect of achieving a better overall production efficiency of the yarn manufacturing textile machine.

On yarn manufacturing textile machines in which each workstation has its own partial handling means for the resumption of the production process at the workstation, the cooperation between the attending device and the partial handling means of the workstation is individually adjusted by the control unit of the yarn manufacturing textile machine for each workstation according to the course of the previous attending operation so that the attending operation takes place in the shortest possible time in order to achieve the maximum production efficiency of the entire yarn manufacturing machine.

The specified parameters on the basis of which the control unit determines the operation of the attending devices and their possible interaction with partial or complete handling means of the workstation, such as the probability of success of the spinning-in process, number of unfinished previous spinning-in processes, cause of the interruption of production process, number of spinning-in processes during bobbin winding, amount or length of yarn produced per unit of time in the past, operating time of selected parts, number of spinning-in processes during bobbin production, number of completed previous spinning-in processes per unit of time, success rate or speed of the attending process of the individual attending devices at a specific workstation, etc.

If these parameters are considered when selecting the next workstation where the production will be resumed, the total time needed to resume the production process at the workstations of the yarn manufacturing textile machine per hour of operation can be minimized and/or the overall production efficiency of the textile yarn manufacturing machine can be increased.

DETAILED DESCRIPTION

The invention will be described with reference to an example of a method for controlling an attending device of a yarn manufacturing textile machine.

The yarn manufacturing textile machine comprises at least one row of identical workstations arranged next to each other. The workstation is well known per se, and therefore, for the sake of completeness, it will be described only symbolically without a picture. Each workstation comprises a spinning unit in which yarn is formed. Above the spinning unit, a draw-off mechanism of yarn is provided, which comprises a known pair of draw-off rollers, between which the yarn passes to a winding device which winds the produced yarn on a bobbin. The yarn winding device comprises a yarn traversing device, by which the yarn is traversed across the bobbin width.

In addition, the workstation may have its own complete or partial handling means for resuming the production activity at the workstation after previous interruption of this activity, for example after the doffing of a wound bobbin, after shutting down the whole yarn manufacturing textile machine or its section, or after a yarn break, etc.

The machine further comprises at least one attending device, which is movable back and forth along at least one row of workstations and which is provided with means for performing attending operations at the individual workstations, such as detecting the broken yarn end on a yarn package, inserting an empty tube in a winding device, spinning-in yarn (onto auxiliary yarn, on the spinning-in end of broken yarn), etc. The attending device is further provided with a control unit which is coupled to the control unit of the yarn manufacturing textile machine and to the control unit of the workstation or a section of the yarn manufacturing textile machine.

The attending device and/or the workstation are further provided with means for terminating the working activity and/or the presence of the attending device at the workstation before the planned termination of working activity and/or presence at the respective workstation.

The control unit of a yarn manufacturing textile machine continuously monitors and evaluates numerous pre-determined production-related parameters using a mathematical model, such as the success rate of the attending attempts of the individual attending device at the individual workstations. The control unit shall, upon receipt of another request for an attending operation from a particular workstation, decide to which position in the sequence of workstations waiting to be operated, the respective workstation will be assigned, or will decide to mark the workstation as inoperable. If the control unit decides to assign to the workstation a position in the sequence of the workstations waiting for the attending operation, then the maximum number of attempts to perform the attending operation is adaptively adjusted according to the mathematical model for the particular workstation and for the particular attending device.

If there are more attending devices, then the statistics are also monitored with respect to the success rate of the individual attending devices at the individual workstations, and according to the statistics, the individual attending devices are assigned to individual workstations and in the corresponding order.

The sequence of the workstations to be attended to changes adaptively. If a new request for an attending operation comes from a workstation which has, for example, considerably better success statistics of the attending operations or which has, for example, significantly better statistics of success of the attending operations or, for example, has a higher working capacity per unit of time, then it is preferred in the sequence of the workstations waiting for the attending operation.

In addition, the control unit has the maximum number of attempts to perform successfully the attending operations at the workstation set for all workstations, hereinafter referred to as the "maximum number of attempts". This maximum number of attempts is fixed and set for each workstation of the entire machine. The maximum number of attempts indicates the maximum possible number of unsuccessful attempts of the attending device to perform an attending operation at each particular machine workstation before this particular workstation is marked as error and the attending device, after performing the maximum number of attempts, leaves the particular workstation regardless of the result of the last attempt, including situations when the workstation has not been attended to.

The invention is based on the concept that each workstation has different parameters, however slight the differences may be, and therefore the success rate of the performed attending operations is different, too. If, according to the statistical success of operations at specific workstations of the machine, the individual success rate of each workstation is monitored, it is possible to determine and set the current maximum number of attempts of the attending device for each workstation to successfully carry out attending operations at a particular workstation, hereinafter only the current maximum number of attempts. The value of the current maximum number of attempts, therefore, describes the real statistical success of the attending operations performed at the particular workstation, whereby this value is less than the maximum number of attempts. This means that, according to the present invention, the attending device performs at each workstation only as many unsuccessful attempts to perform an attending operation as may be determined from the statistics of the actual success rate of the attending operations at the particular workstation, but the number of unsuccessful attempts must not be higher than the maximum number of attempts. It is assumed that if a specific workstation is statistically less successful in carrying out attending operations, the probability that the given attending operation will be successful with more than the actual (real) statistical number of attempts is small. Therefore, if the attending device operates at a specific workstation which has a certain statistically determined current maximum number of attempts, and there is another workstation requiring an attending operation on the machine, this other workstation having a lower value of the current maximum number of attempts, the control unit will make a decision on the basis of these current values and on the basis of any other parameters that allow to observe and determine the overall efficiency of the entire machine (distance between the two workstations, speed of the movement of the attending device, the success rate of the attending operation at the other workstation, the performance of the particular workstation, the working time of the particular workstation, etc.), about premature termination of the attending operation at the workstation statistically worse (which is being currently attended to). The decision is made already (even) before the maximum number of attempts has been exhausted, and the attending device goes to the statistically more advantageous workstation, whereas the workstation which has been attended to up to now, but is statistically worse, remains unattended or continues the attending operation with the assistance of its own means.

Premature termination of attending operations at a statistically worse workstation is carried out according to one embodiment in such a manner that the attending device completes its active activities at the workstation and passes the yarn to the means of the workstation to a defined position, and afterwards leaves the workstation waiting for further attending operations.

According to another embodiment, the premature termination of attending operations at a statistically worse workstation is carried out by the attending device completing its active activities at the workstation, passing the yarn to the means of the workstation, and without waiting for the successful completion of all attending operations at that workstation by the means of the workstation, this attending device moves over to a statistically better (more advantageous) workstation on which the attending operation starts.

In the meantime, the means at the original, statistically worse, workstation finish the attending operations without the attending device being present at this workstation, and according to the success rate of the completion of the attending operation, the workstation either resumes its production activity, or this statistically worse workstation waits for further attending operations.

Taking into account the movement of the attending device between the individual workstations, it is also the length of the time interval (distance) for moving the attending device from its current working position to the workstation requesting an attending operation that is considered, wherein the workstation with a shorter time interval (a shorter distance) is attended to preferably.

The control unit controls the operation and interoperability of the attending devices and workstations using the mathematical model of the machine which takes into account selected production-related and quality parameters, as well as their possible interaction and combinations, in order to achieve the greatest possible production efficiency of the whole yarn making textile machine during its manufacturing activity and to determine the operation of the attending devices and their possible interaction with partial or complete handling means of the workstation. In determination of the sequence of the workstations to be operated, a workstation with a higher amount of yarn produced per unit of time, etc., is preferred, i.e. the parameter of the highest achievable efficiency of the machine as a whole is applied. Similarly, account is also taken of the fact that the particular workstation is operated by a particular attending device with a higher or lower success rate than when operated by another attending device, etc.

The invention can be used in the operation of yarn manufacturing textile machines provided with attending devices for yarn manufacturing textile machines.

Modifications and variations can be made to the embodiments illustrated or described herein without departing from the scope and spirit of the invention as set forth in the appended claims.

The invention claimed is:

1. A method for controlling movement and operation of an attending device of a yarn manufacturing textile machine, wherein the attending device moves along a row of workstations arranged next to each other to perform operations at the workstations, comprising:

controlling the movement of the attending device along the work stations and operations of the attending device based on success statistics of the operations at the workstations to achieve an overall increased efficiency of the textile machine; and terminating an operating stay of the attending device at a particular one of the work stations without waiting for a result of the operation being performed by the attending device at the particular workstation and, based on a model, performing operations with the attending device at a different workstation to resume working activity at the different workstation so as to achieve a higher increased efficiency of the textile machine as compared to continuing the operation of the attending device at the particular work station.

2. The method according to claim 1, wherein the operating stay of the attending device at the particular workstation is terminated after the attending device performs a predetermined number of attempts to successfully complete the operation.

3. The method according to claim 2, wherein the predetermined number of attempts is individualized for each of the workstations.

4. The method according to claim 3, characterized in that the predetermined number of attempts is determined for each of the workstations based on the success statistics of the operations at the workstations.

5. A method for controlling movement and operation of an attending device of a yarn manufacturing textile machine, wherein the attending device moves along a row of workstations arranged next to each other to perform operations at the workstations, comprising:

controlling the movement of the attending device along the workstations and operations of the attending device based on success statistics of the operations at the workstations to achieve an overall increased efficiency of the textile machine;

terminating an operating stay of the attending device at a particular one of the work stations without waiting for a result of the operation being performed by the attending device at the particular workstation;

wherein the operating stay of the attending device at the particular workstation is terminated after the attending device performs a predetermined number of attempts to successfully complete the operation;

wherein the predetermined number of attempts is individualized for each of the workstations based on the success statistics of the operations at the workstations; and wherein the success statistics of the operations at the workstations are updated after each attempt performed to complete the operation.

6. A method for controlling movement and operation of an attending device of a yarn manufacturing textile machine, wherein the attending device moves along a row of workstations arranged next to each other to perform operations at the workstations, comprising:

controlling the movement of the attending device along the workstations and operations of the attending device based on success statistics of the operations at the workstations to achieve an overall increased efficiency of the textile machine;

terminating an operating stay of the attending device at a particular one of the workstations without waiting for a result of the operation being performed by the attending device at the particular workstation; and wherein the operating stay of the attending device at the particular work station is terminated before the attending device performs a predetermined number of attempts to successfully complete the operation after a determination that performing one of the operations at another workstation will lead to improved efficiency of the textile machine, whereupon the attending device moves to the other workstation and performs one of the operations at the other workstation.

7. The method according to claim 6, wherein upon terminating the operating stay of the attending device at the particular workstation, the attending device passes a yarn formed at the particular workstation to means at the particular workstation.

8. The method according to claim 7, wherein upon terminating the operating stay of the attending device at the particular workstation, the particular workstation is flagged for one or more subsequent actions of: checking for successful performance of the operation; completion of the operation by subsequent arrival of the attending device or another attending device; and completion of the operation by the means at the particular workstation.

9. The method according to any of claim 7, wherein the means at the particular workstation hold the yarn for completing the operation at a later stage.

* * * * *